US008857096B2

(12) United States Patent
McClintock

(10) Patent No.: US 8,857,096 B2
(45) Date of Patent: Oct. 14, 2014

(54) FORWARD PISTOL MOUNT

(71) Applicant: Troy Rhea McClintock, Redmond, OR (US)

(72) Inventor: Troy Rhea McClintock, Redmond, OR (US)

( * ) Notice: Subject to any disclaimer, the term of this patent is extended or adjusted under 35 U.S.C. 154(b) by 0 days.

(21) Appl. No.: 13/967,140

(22) Filed: Aug. 14, 2013

(65) Prior Publication Data

US 2014/0047755 A1 Feb. 20, 2014

Related U.S. Application Data

(60) Provisional application No. 61/682,885, filed on Aug. 14, 2012.

(51) Int. Cl.
*F41C 27/00* (2006.01)
*F41G 11/00* (2006.01)

(52) U.S. Cl.
CPC ..... *F41C 27/00* (2013.01); *F41G 11/003* (2013.01)
USPC ..... 42/90; 42/72; 89/37.04

(58) Field of Classification Search
USPC ..... 42/71.01, 72, 90, 105, 106; 89/37.01, 89/37.04
See application file for complete search history.

(56) References Cited

U.S. PATENT DOCUMENTS

| | | | | |
|---|---|---|---|---|
| 1,478,027 | A * | 12/1923 | Winthrop et al. | 552/276 |
| 2,075,704 | A * | 3/1937 | Crosby | 42/106 |
| 4,195,432 | A * | 4/1980 | Hickman | 42/106 |
| 6,318,014 | B1 * | 11/2001 | Porter | 42/72 |
| 7,117,625 | B2 * | 10/2006 | Pikielny | 42/90 |
| 8,371,056 | B1 * | 2/2013 | Baker et al. | 42/90 |
| 8,739,452 | B1 * | 6/2014 | Calvert | 42/90 |
| 2005/0188591 | A1 * | 9/2005 | Stone | 42/75.02 |
| 2011/0225865 | A1 * | 9/2011 | Williams | 42/90 |
| 2014/0157644 | A1 * | 6/2014 | Jiminez et al. | 42/114 |

* cited by examiner

*Primary Examiner* — Gabriel Klein

(57) ABSTRACT

A forward pistol mount for mounting a pistol to a rifle. The forward pistol mount has an external mount structure that attaches to the lower tactical rail of the rifle. The pistol is attached to an internal mount structure of the forward pistol mount. The internal mount structure is positioned within the external mount structure and clamps around the lower tactical rail of the pistol. A securing mechanism that can be positioned on either side of the forward pistol mount allows for the quick release or insertion of the pistol within the internal mount structure. The present invention allows the pistol to provide the same grip as a pistol grip accessory but with the actual firing power of a gun, thus allowing for zero transition time between weapons.

19 Claims, 9 Drawing Sheets

FORWARD PISTOL MOUNT

The current application claims a priority to the U.S. Provisional Patent application Ser. No. 61/682,885 filed on Aug. 14, 2012.

FIELD OF THE INVENTION

The present invention relates generally to a firearm accessory. More specifically, the present invention is an apparatus that allows a user to mount a pistol onto the lower tactical rail of a rifle. Furthermore, the present invention can be used with any pistol or rifle having a universally shaped tactical rail.

BACKGROUND OF THE INVENTION

For many firearm enthusiasts, tactical rail accessories are very popular and are used to create custom weapon systems that cater to the needs of the user. Many of these tactical rail accessories are even used with airsoft guns and paintball guns. One of the first accessories that is typically added to a weapon system is a pistol grip. A pistol grip increases the stability of the firearm as it is fired, thus increasing the accuracy of the firearm. Additionally, pistol grips are added to provide additional comfort for the user while shooting. Other common weapon accessories include laser pointers, flashlights, and scopes.

When engaged in combat, it is common for an individual to carry a primary weapon and a secondary weapon. The primary weapon is typically a rifle, while the secondary weapon is typically a pistol. In general the secondary weapon has less firing power than the primary weapon, the primary weapon being used for long range combat and the secondary weapon being used for close combat. Another important reason for carrying two weapons is that it is common for a weapon to malfunction while in use. When a weapon malfunctions it leaves the individual vulnerable for a period of time as they must either fix their weapon or transition to their secondary weapon.

Therefore it is the object of the present invention to provide an apparatus that allows a user to mount a pistol to a rifle. An external mount structure attaches to the lower tactical rail of the rifle, while the pistol is attached to an internal mount structure. The internal mount structure is positioned within the external mount structure and clamps around the lower tactical rail of the pistol. A securing mechanism allows for the quick release or insertion of the pistol within the internal mount structure. The present invention allows the pistol to provide the same grip as a pistol grip accessory but with the actual firing power of a gun. This allows for zero transition time between weapons.

DETAIL DESCRIPTIONS OF THE INVENTION

All illustrations of the drawings are for the purpose of describing selected versions of the present invention and are not intended to limit the scope of the present invention.

The present invention is a forward pistol mount. The forward pistol mount is a firearm accessory that allows a user to mount a pistol onto the lower tactical rail of a rifle, without altering the pistol in any way. In this way, the pistol provides the same grip as a pistol grip accessory, with the additional benefit of having the actual firing power of a gun. The forward pistol mount can be used with any type of firearm including, but not limited to, airsoft weapons and paintball weapons. The forward pistol mount is universally designed in that any pistol with a lower tactical rail can be secured to the forward pistol mount.

Figure 1:
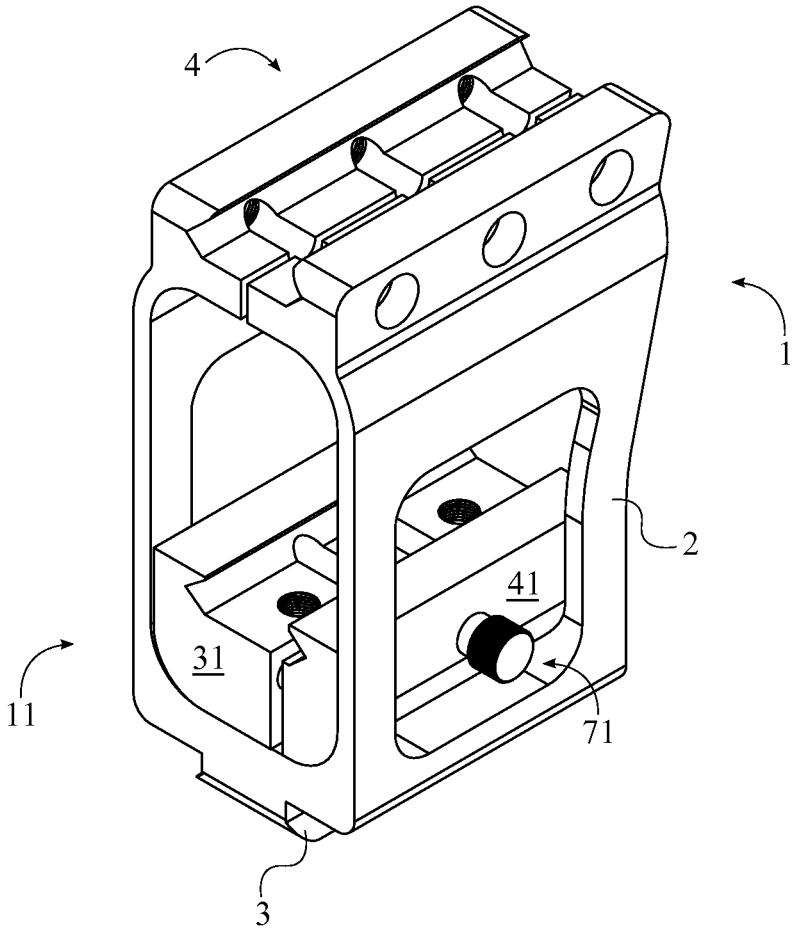
FIG. 1 is a perspective view of the assembly of the external mount structure and the internal mount structure.

In reference to FIG. 1, the forward pistol mount comprises an external mount structure 1 and an internal mount structure 11. The external mount structure 1 is attached to the lower tactical rail of the rifle, with the internal mount structure 11 attached within the external mount structure 1. Once the external mount structure 1 has been securely attached to the rifle, the pistol can then be positioned within the external mount structure 1 and secured to the internal mount structure 11. The forward pistol mount can be left attached to the rifle when not in use without affecting the performance of the rifle.

Figure 18:
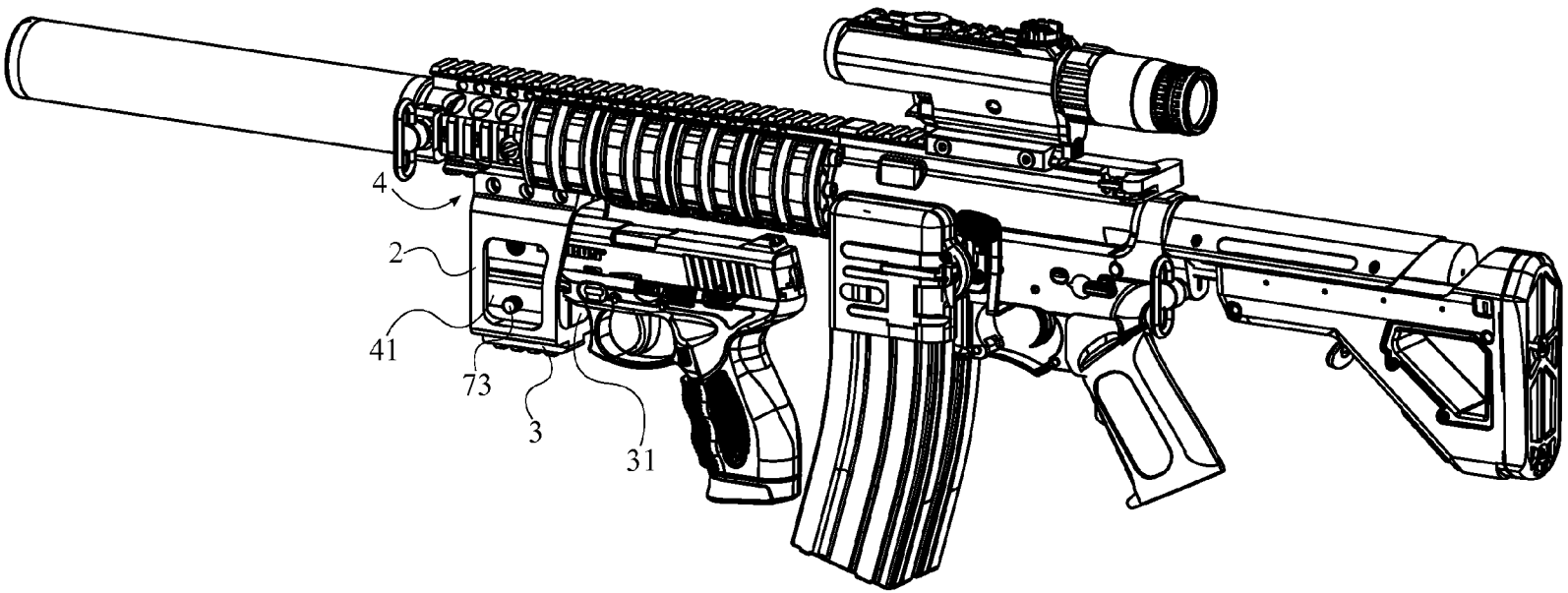
FIG. 18 is a perspective view of the forward pistol mount being used to attach a pistol to a rifle.
Figure 19:
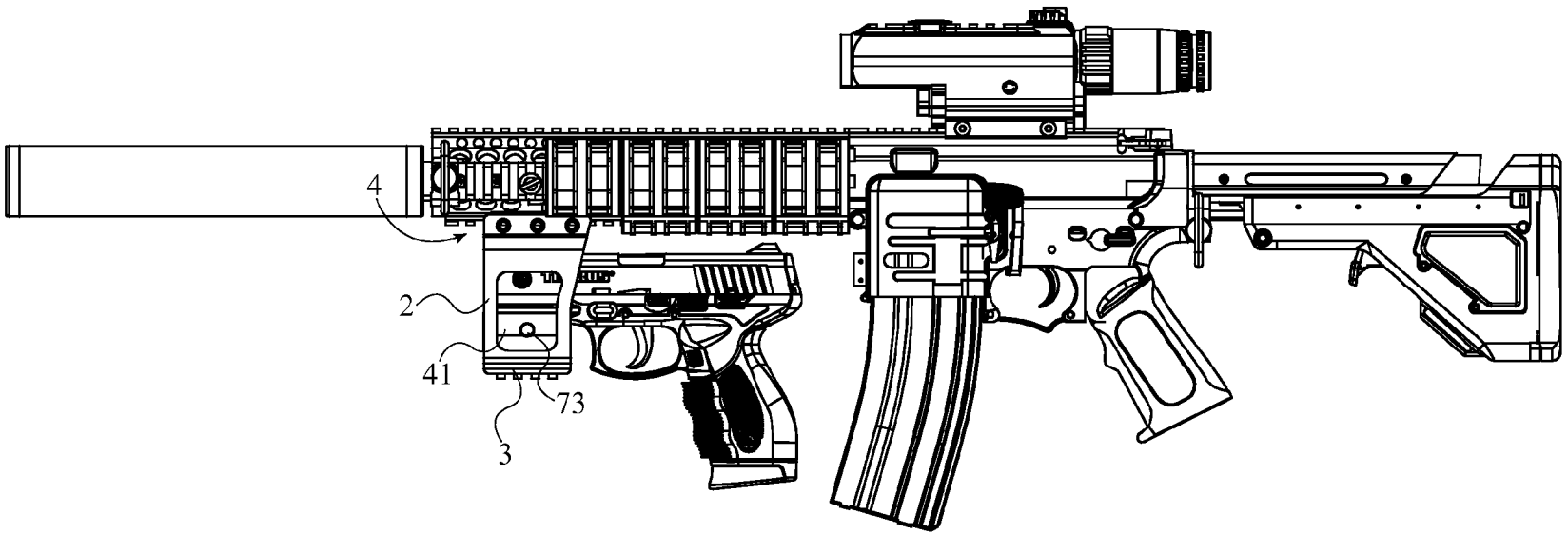
FIG. 19 is a left-side elevational view of the forward pistol mount being used to attach a pistol to a rifle.

The external mount structure 1 is the component that is attached to the rifle, as shown in FIG. 18-19. In reference to FIG. 3-7, the external mount structure 1 comprises a mount frame 2, an external-male tactical rail 3, and an external-female tactical rail 4. The external-female tactical rail 4 is adjacently connected to the mount frame 2 and forms the top of the external mount structure 1. Similarly, the external-male tactical rail 3 is adjacently connected to the mount frame 2 opposite the external-female tactical rail 4, thus forming the bottom of the external mount structure 1. The external-female tactical rail 4 provides a track portion of the external mount structure 1 that engages the lower tactical rail of the rifle. The external-female tactical rail 4 slips over the lower tactical rail of the rifle allowing the external mount structure 1 to be slid into the desired position. Once the external mount structure 1 is in the desired position, cap screws are inserted through screw holes in the external-female tactical rail 4, shown in FIG. 4. The cap screws engage the lower tactical rail of the rifle and prevent the external mount structure 1 from sliding out of position. The screw holes consist of smoothbore holes and threaded holes, each on opposite sides of the external-female tactical rail 4. The cap screws are inserted first through the smoothbore holes in one side of the external-female tactical rail 4 and then through the lower tactical rail of the rifle. The cap screws then engage the threaded holes on the opposite side of the external-female tactical rail 4. Finally, the cap screws are tightened into place within the threaded holes, ensuring that the external mount structure 1 cannot slide along the lower tactical rail of the rifle.

Figure 3:
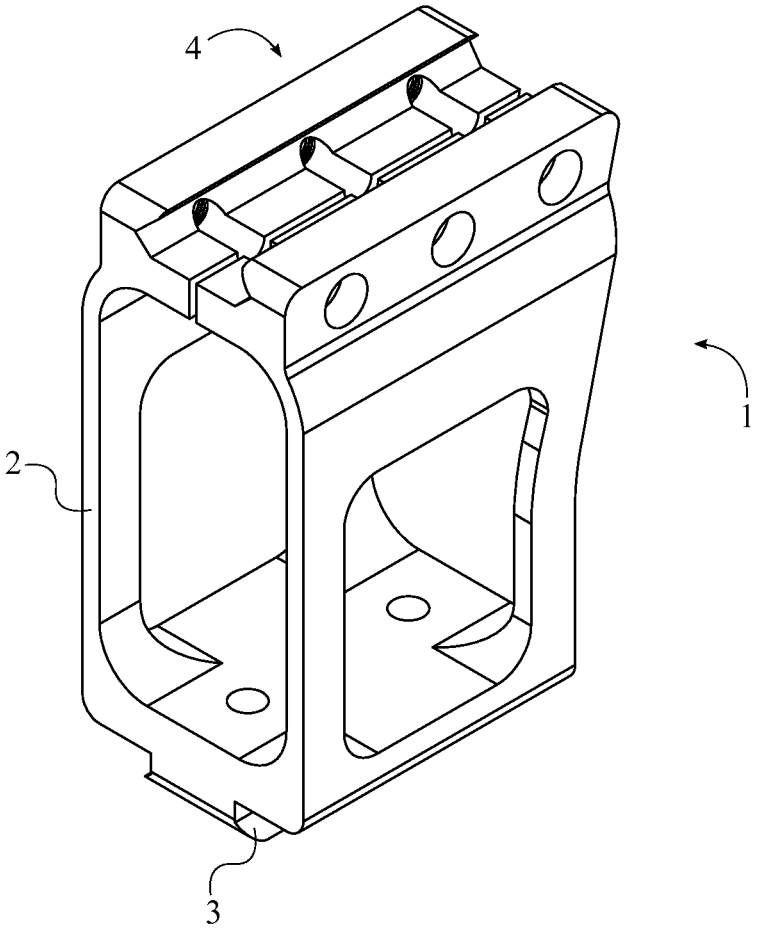
FIG. 3 is a perspective view of the external mount structure.
Figure 4:
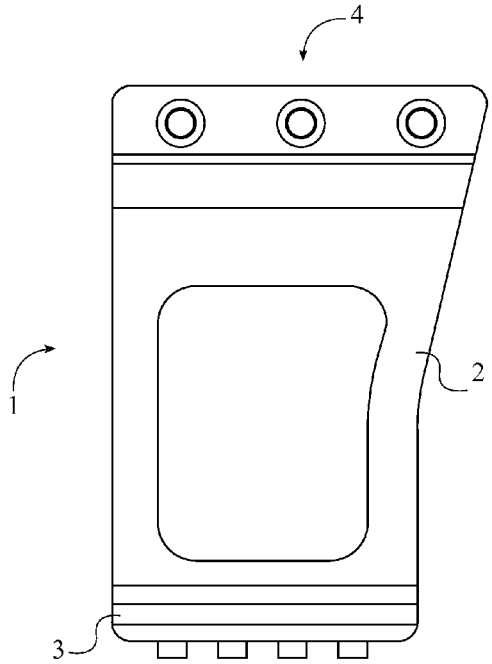
FIG. 4 is a right-side elevational view of the external mount structure.
Figure 5:
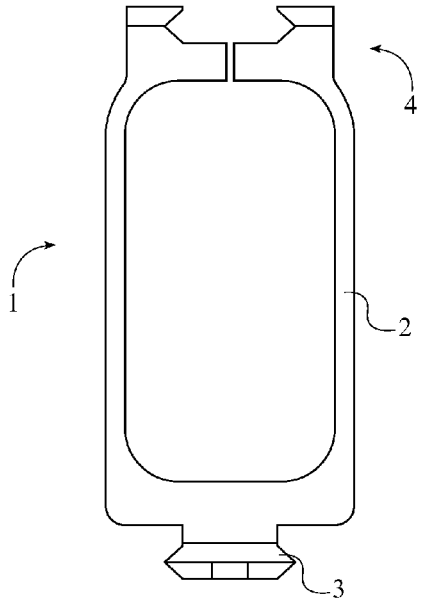
FIG. 5 is a front elevational view of the external mount structure.
Figure 6:
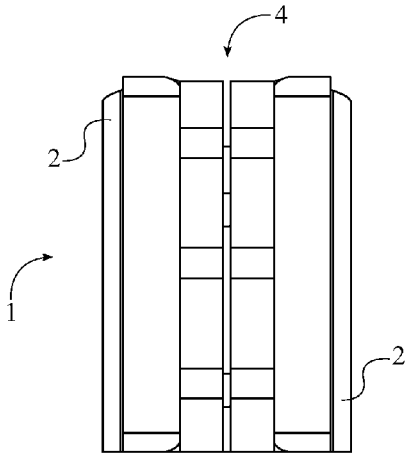
FIG. 6 is a top plan view of the external mount structure.
Figure 7:
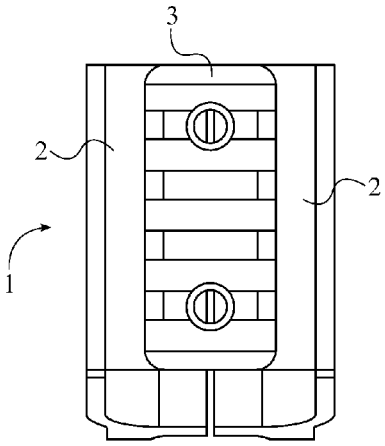
FIG. 7 is a bottom plan view of the external mount structure.

In further reference to FIG. 3-7, the mount frame 2 is an open frame structure that connects the external-male tactical rail 3 and the external-female tactical rail 4. The mount frame 2 also provides a mounting surface for the internal mount structure 11 and an opening for the pistol to pass through. The external-male tactical rail 3, connected to the bottom of the mount frame 2, provides a bottom track portion of the external mount structure 1 that can be used to attach additional firearm accessories to the weapon system, such as a laser pointer or flashlight. A pair of smoothbore holes traverse up through the external-male tactical rail 3 and through the mounting surface of the mount frame 2, as can be seen in FIG. 3 and FIG. 7. When the internal mount structure 11 is positioned within the mount frame 2, a pair of threaded holes in the internal mount structure 11 is aligned with the pair of smoothbore holes traversing through the external-male tactical rail 3 and the mount frame 2. Once aligned, a pair of cap screws is inserted through the smoothbore holes of the external-male tactical rail 3 and mount frame 2 and into the threaded holes of the internal mount structure 11. The pair of cap screws engages the threaded holes of the internal mount structure 11, securely tightening into place. It is also possible for any other means of connection to be used to attach the internal mount structure 11 to the external mount structure 1.

Figure 9:
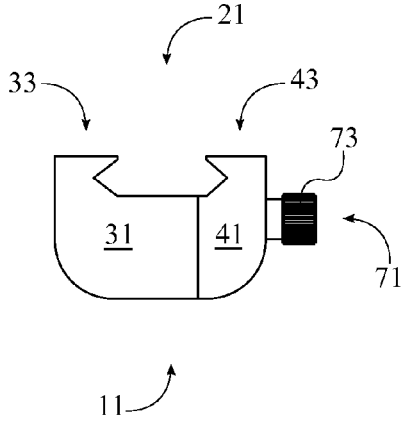
FIG. 9 is a front elevational view of the internal mount structure.

The internal mount structure 11 is positioned within the mount frame 2 and is the component to which the pistol is attached. In reference to FIG. 9-10, the internal mount structure 11 comprises an internal-female tactical rail 21, a first mount block 31, a second mount block 41, a first alignment pin 51, a second alignment pin 61, and a securing mechanism 71. The threaded holes of the internal mount structure 11 traverse through the first mount block 31, such that the first mount block 31 is attached to the mounting surface of the mount frame 2. While the first mount block 31 is attached to the mount frame 2, the second mount block 41 is attached to the first mount block 31 by the securing mechanism 71. The internal-female tactical rail 21 forms a track portion of the internal mount structure 11 through which the lower tactical rail of the pistol is inserted. Once the pistol is positioned within the internal-female tactical rail 21, the securing mechanism 71 is tightened in order to clamp the pistol between the first mount block 31 and the second mount block 41. The internal mount structure 11 is removably attached to the external mount structure 1 in order to allow the securing mechanism 71 to be positioned on either the right or left side of the forward pistol mount, depending on the comfort of the user. When the internal mount structure 11 is attached to the external mount structure 1, the external-male tactical rail 3, external-female tactical rail 4, and internal-female tactical rail 21 are aligned parallel to each other in order to ensure safe firing of the pistol and proper alignment of any additional attachments.

Figure 8:
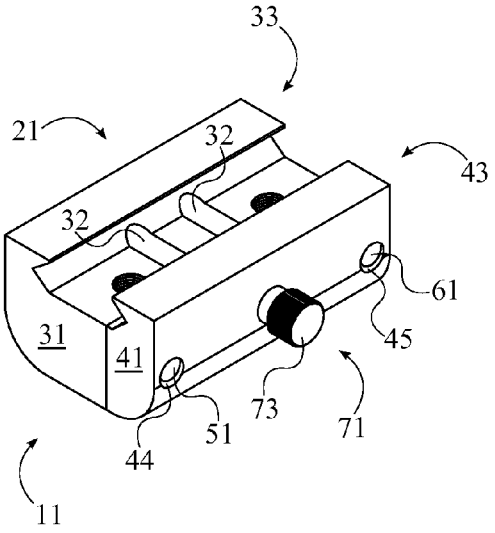
FIG. 8 is a perspective view of the internal mount structure.
Figure 11:
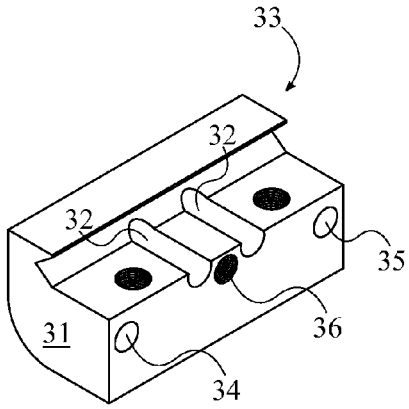
FIG. 11 is a perspective view of the first mount block.
Figure 12:
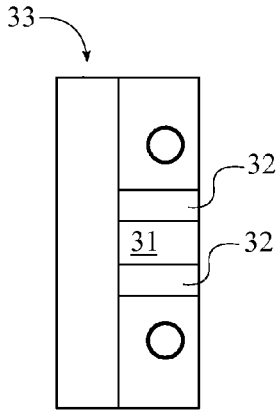
FIG. 12 is a top plan view of the first mount block.
Figure 15:
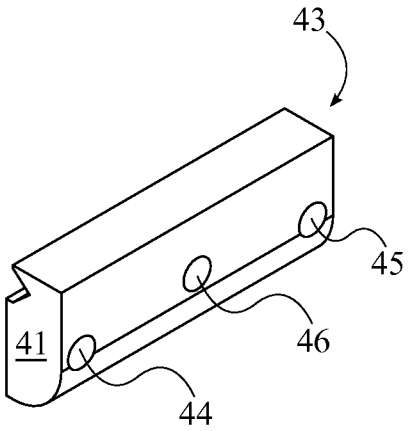
FIG. 15 is a perspective view of the second mount block.

The main body of the internal mount structure 11 is formed by the first mount block 31 and the second mount block 41. In reference to FIG. 11 and FIG. 15, the first mount block 31 comprises a plurality of lug slots 32, a first rail portion 33, a first pin cavity 34, a second pin cavity 35, and a bolt cavity 36, while the second mount block 41 comprises a second rail portion 43, a first guide hole 44, a second guide hole 45, and a bolt hole 46. The first rail portion 33 is positioned along the first mount block 31, while the second rail portion 43 is positioned along the second mount block 41. When the first mount block 31 and second mount block 41 are clamped together by the securing mechanism 71, the first rail portion 33 and second rail portion 43 are longitudinally aligned in order to form the internal-female tactical rail 21, as shown in FIG. 8. The first rail portion 33 forms the bottom portion of the internal-female tactical rail 21 and one side of the internal-female tactical rail 21, while the second rail portion 43 forms the opposite side of the internal-female tactical rail 21. In this way, the first rail portion 33 and second rail portion 43 clamp around the lower tactical rail of the pistol when the securing mechanism 71 is tightened. The plurality of lug slots 32 traverses across the first mount block 31, through the first rail portion 33. Each of the plurality of lug slots 32 provides a channel in which a recoil lug can be placed in order to prevent the pistol from sliding along the internal-female tactical rail 21 when the pistol is fired.

Figure 2:
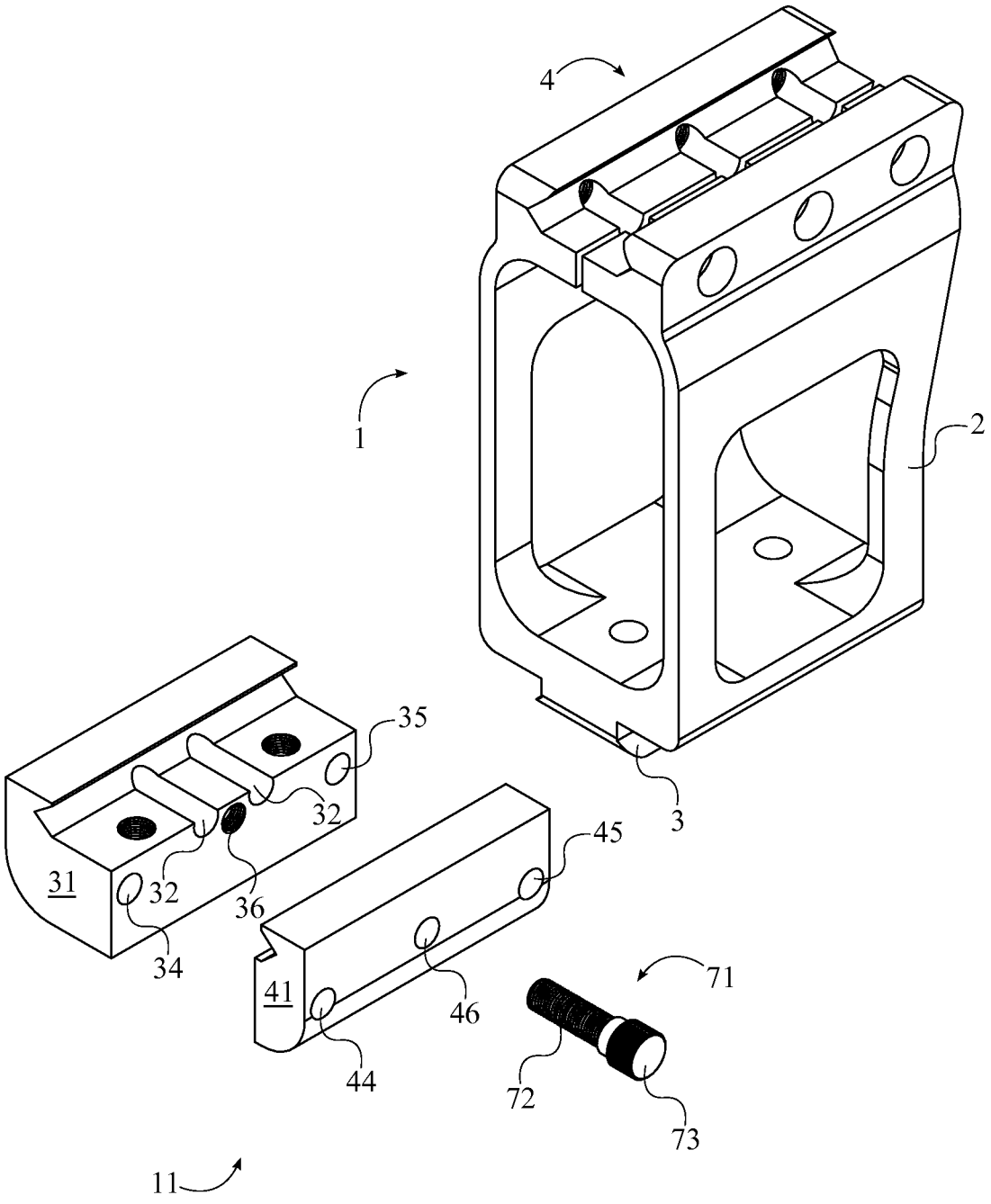
FIG. 2 is an exploded view of the external mount structure and the internal mount structure.
Figure 10:
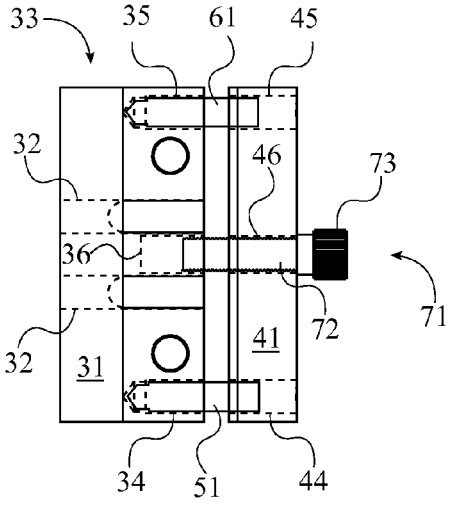
FIG. 10 is a top plan view of the internal mount structure showing selected hidden lines.

In reference to FIG. 2, the securing mechanism 71 comprises a bolt 72 and a fastener 73. The bolt 72 is a threaded rod that is inserted through both the first mount block 31 and the second mount block 41. The bolt 72 traverses through the bolt hole 46 of the second mount block 41 into the bolt cavity 36 of the first mount block 31, as shown in FIG. 10. The bolt hole 46 is a smoothbore hole, while the bolt cavity 36 is a threaded hole. The threads of the bolt 72 engage the threads of the bolt cavity 36 such that the bolt 72 is attached to the first mount block 31 within the bolt cavity 36. The fastener 73 is attached to one end of the bolt 72 and is positioned adjacent to the second mount block 41 opposite the first mount block 31 when the bolt 72 is inserted through the first mount block 31 and second mount block 41. The fastener 73 provides a grip for the user to turn the bolt 72 in order to tighten or loosen the securing mechanism 71. As the securing mechanism 71 is tightened, the first mount block 31 and the second mount block 41 clamp together in order to secure the pistol in place. Conversely, as the securing mechanism 71 is loosened, the first mount block 31 and the second mount block 41 separate allowing the pistol to be detached from the internal mount structure 11. The securing mechanism 71 may function as a thumb screw, quick locking lever, or any other similar mechanism.

In an alternative embodiment of the present invention, the bolt 72 is permanently connected to the first mount block 31. The second mount block 41 is slipped around the bolt 72, with the bolt 72 traversing through the bolt hole 46 of the second mount block 41. In the alternative embodiment, the fastener 73 has a threaded hole that traverses all the way through the fastener 73. In this way, the fastener 73 is screwed into place around the bolt 72 in order to attach the second mount block 41 to the first mount block 31.

In reference to FIG. 10, the first alignment pin 51 and the second alignment pin 61 ensure that the first mount block 31 and the second mount block 41 properly align when clamped together by the securing mechanism 71. The first alignment pin 51 and the second alignment pin 61 are attached to the first mount block 31, while the second mount block 41 is slideably engaged to the both the first alignment pin 51 and the second alignment pin 61. The first alignment pin 51 and the second alignment pin 61 ensure proper alignment by limiting the second mount block 41 to one degree of freedom. The first alignment pin 51 and the second alignment pin 61 are parallel with the bolt 72 of the securing mechanism 71, such that as the securing mechanism 71 is tightened, the second mount block 41 is guided along the first alignment pin 51 and the second alignment pin 61 and the first rail portion 33 and second rail portion 43 properly align to form the internal-female tactical rail 21.

In further reference to FIG. 10, the first pin cavity 34 of the first mount block 31 provides an anchor position for the first alignment pin 51, while the second pin cavity 35 of the first mount block 31 provides an anchor position for the second alignment pin 61. The first alignment pin 51 is attached to the first mount block 31 within the first pin cavity 34 and the second alignment pin 61 is attached to the first mount block 31 within the second pin cavity 35. The first alignment pin 51 and the second alignment pin 61 can be attached within the first pin cavity 34 and the second pin cavity 35, respectively, by any means, such as through a threaded engagement or a snap fit. When attached to the first mount block 31, the first alignment pin 51 traverses out of the first pin cavity 34 of the first mount block 31 through the first guide hole 44 of the second mount block 41. Similarly, the second alignment pin 61 traverses out of the second pin cavity 35 of the first mount block 31 through the second guide hole 45 of the second mount block 41, when attached to the first mount block 31.

Figure 13:
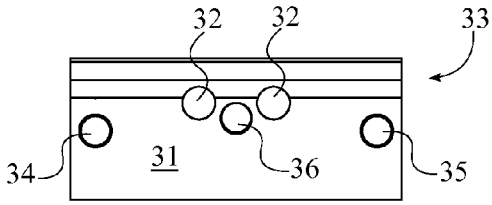
FIG. 13 is a right-side elevational view of the first mount block.
Figure 14:
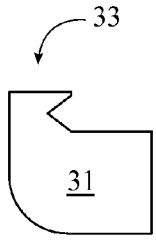
FIG. 14 is a front elevational view of the first mount block.
Figure 16:
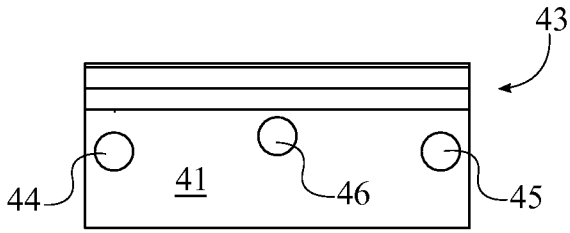
FIG. 16 is a left-side elevational view of the second mount block.
Figure 17:
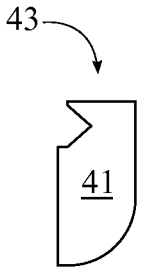
FIG. 17 is a front elevational view of the second mount block.

In reference to FIG. 13, the first pin cavity 34 and second pin cavity 35 are positioned opposite of each other along the first mount block 31, such that the first pin cavity 34 and the second pin cavity 35 are positioned around the bolt cavity 36. The first pin cavity 34 and the second pin cavity 35 laterally traverse into the first mount block 31 and are parallel to both the plurality of lug slots 32 and the bolt cavity 36. Additionally, the first pin cavity 34 and the second pin cavity 35 are concentric with the first guide hole 44 and the second guide hole 45. In reference to FIG. 16, similar to the first pin cavity 34 and the second pin cavity 35, the first guide hole 44 and the second guide hole 45 are positioned opposite of each other along the second mount block 41, such that the first guide hole 44 and the second guide hole 45 are positioned around the bolt hole 46. The first guide hole 44 and the second guide hole 45 laterally traverse through the second mount block 41 and are parallel to the bolt hole 46.

Although the invention has been explained in relation to its preferred embodiment, it is to be understood that many other possible modifications and variations can be made without departing from the spirit and scope of the invention as hereinafter claimed.

What is claimed is:

1. A forward pistol mount for mounting a pistol to a rifle, comprising:

an external mount structure;

an internal mount structure;

the external mount structure comprises a mount frame, an external-male tactical rail, and an external-female tactical rail configured to engage a male tactical rail of a rifle;

the internal mount structure comprises an internal-female tactical rail configured to engage a male tactical rail of a pistol, a first mount block, a second mount block, and a securing mechanism;

the external-female tactical rail being adjacently connected to the mount frame;

the external-male tactical rail being adjacently connected to the mount frame opposite the external-female tactical rail;

the internal mount structure being positioned within the mount frame;

the internal mount structure being removably attached to the external mount structure;

the second mount block being attached to the first mount block by the securing mechanism; and the external-male tactical rail, the external-female tactical rail, and the inner tactical female rail being aligned parallel to each other.

2. The forward pistol mount as claimed in claim 1 comprising:

the first mount block comprises a first pin cavity, a second pin cavity, a plurality of lug slots, and a bolt cavity;

the first pin cavity and the second pin cavity being positioned opposite of each other along the first mount block;

the first pin cavity, the second pin cavity, and the bolt cavity laterally traversing into the first mount block;

the plurality of lug slots traversing across the first mount block; and the first pin cavity, the second pin cavity, the bolt cavity, and the plurality of lug slots being parallel to each other.

3. The forward pistol mount as claimed in claim 1 comprising:

the second mount block comprises a first guide hole, a second guide hole, and a bolt hole;

the first guide hole and the second guide hole being positioned opposite of each other along the second mount block;

the first guide hole, the second guide hole, and the bolt hole laterally traversing through the second mount block; and the first guide hole, the second guide hole, and the bolt hole being parallel to each other.

4. The forward pistol mount as claimed in claim 1 comprising:

the first mount block comprises a bolt cavity;

the second mount block comprises a bolt hole;

the securing mechanism comprises a bolt and a fastener;

the bolt traversing through the bolt hole and into the bolt cavity;

the bolt being attached to the first mount block within the bolt cavity;

the fastener being positioned adjacent to the second mount block opposite the first mount block; and the fastener being attached to the bolt.

5. The forward pistol mount as claimed in claim 1 comprising:

the first mount block comprises a first pin cavity, a second pin cavity, and a plurality of lug slots;

the first pin cavity and the second pin cavity being positioned opposite of each other along the first mount block;

the first pin cavity and the second pin cavity laterally traversing into the first mount block;

the plurality of lug slots traversing across the first mount block; and the first pin cavity, the second pin cavity, and the plurality of lug slots being parallel to each other.

6. The forward pistol mount as claimed in claim 1 comprising:

the second mount block comprises a bolt hole;

the securing mechanism comprises a bolt and a fastener;

the bolt being connected to the first mount block;

the bolt traversing through the bolt hole;

the fastener being positioned adjacent to the second mount block opposite the first mount block; and the fastener engaging the bolt.

7. The forward pistol mount as claimed in claim 1 comprising:

the internal mount structure further comprises a first alignment pin and a second alignment pin;

the first mount block comprises a first pin cavity and a second pin cavity;

the second mount block comprises a first guide hole and a second guide hole;

the first alignment pin traversing out of the first pin cavity through the first guide hole;

the first alignment pin being attached to the first mount block within the first pin cavity;

the second alignment pin traversing out of the second pin cavity through the second guide hole; and the second alignment pin being attached to the first mount block within the second pin cavity.

8. A forward pistol mount for mounting a pistol to a rifle, comprising:

an external mount structure;

an internal mount structure;

the external mount structure comprises a mount frame, an external-male tactical rail, and an external-female tactical rail configured to engage a male tactical rail of a pistol;

the internal mount structure comprises an internal-female tactical rail configured to engage a male tactical rail of a pistol, a first mount block, a second mount block, and a securing mechanism;

the first mount block comprises a first rail portion;

the second mount block comprises a second rail portion;

the external-female tactical rail being adjacently connected to the mount frame;

the external-male tactical rail being adjacently connected to the mount frame opposite the external-female tactical rail;

the internal mount structure being positioned within the mount frame;

the internal mount structure being removably attached to the external mount structure;

the second mount block being attached to the first mount block by the securing mechanism;

the first rail portion being positioned along the first mount block;

the second rail portion being positioned along the second mount block;

the first rail portion and the second rail portion being longitudinally aligned in order to form the internal-female tactical rail; and the external-male tactical rail, the external-female tactical rail, and the inner tactical female rail being aligned parallel to each other.

9. The forward pistol mount as claimed in claim 8 comprising:

the first mount block further comprises a first pin cavity, a second pin cavity, a plurality of lug slots, and a bolt cavity;

the first pin cavity and the second pin cavity being positioned opposite of each other along the first mount block;

the first pin cavity, the second pin cavity, and the bolt cavity laterally traversing into the first mount block;

the plurality of lug slots traversing across the first mount block; and the first pin cavity, the second pin cavity, the bolt cavity, and the plurality of lug slots being parallel to each other.

10. The forward pistol mount as claimed in claim 8 comprising:

the second mount block further comprises a first guide hole, a second guide hole, and a bolt hole;

the first guide hole and the second guide hole being positioned opposite of each other along the second mount block;

the first guide hole, the second guide hole, and the bolt hole laterally traversing through the second mount block; and the first guide hole, the second guide hole, and the bolt hole being parallel to each other.

11. The forward pistol mount as claimed in claim 8 comprising:

the first mount block further comprises a bolt cavity;

the second mount block further comprises a bolt hole;

the securing mechanism comprises a bolt and a fastener;

the bolt traversing through the bolt hole and into the bolt cavity;

the bolt being attached to the first mount block within the bolt cavity;

the fastener being positioned adjacent to the second mount block opposite the first mount block; and the fastener being attached to the bolt.

12. The forward pistol mount as claimed in claim 8 comprising:

the first mount block further comprises a first pin cavity, a second pin cavity, and a plurality of lug slots;

the first pin cavity and the second pin cavity being positioned opposite of each other along the first mount block;

the first pin cavity and the second pin cavity laterally traversing into the first mount block;

the plurality of lug slots traversing across the first mount block; and the first pin cavity, the second pin cavity, and the plurality of lug slots being parallel to each other.

13. The forward pistol mount as claimed in claim 8 comprising:

the second mount block further comprises a bolt hole;

the securing mechanism comprises a bolt and a fastener;

the bolt being connected to the first mount block;

the bolt traversing through the bolt hole;

the fastener being positioned adjacent to the second mount block opposite the first mount block; and the fastener engaging the bolt.

14. The forward pistol mount as claimed in claim 8 comprising:

the internal mount structure further comprises a first alignment pin and a second alignment pin;

the first mount block further comprises a first pin cavity and a second pin cavity;

the second mount block further comprises a first guide hole and a second guide hole;

the first alignment pin traversing out of the first pin cavity through the first guide hole;

the first alignment pin being attached to the first mount block within the first pin cavity;

the second alignment pin traversing out of the second pin cavity through the second guide hole; and the second alignment pin being attached to the first mount block within the second pin cavity.

15. A forward pistol mount for mounting a pistol to a rifle, comprising:

an external mount structure;

an internal mount structure;

the external mount structure comprises a mount frame, an external-male tactical rail, and an external-female tactical rail configured to engage a male tactical rail of a rifle;

the internal mount structure comprises an internal-female tactical rail configured to engage a male tactical rail of a pistol, a first mount block, a second mount block, a first alignment pin, a second alignment pin, and a securing mechanism;

the first mount block comprises a first rail portion, a first pin cavity, a second pin cavity, and a plurality of lug slots;

the second mount block comprises a second rail portion, a first guide hole, and a second guide hole;

the external-female tactical rail being adjacently connected to the mount frame;

the external-male tactical rail being adjacently connected to the mount frame opposite the external-female tactical rail;

the internal mount structure being positioned within the mount frame;

the internal mount structure being removably attached to the external mount structure;

the second mount block being attached to the first mount block by the securing mechanism;

the first rail portion being positioned along the first mount block;

the second rail portion being positioned along the second mount block;

the first rail portion and the second rail portion being longitudinally aligned in order to form the internal-female tactical rail;

the external-male tactical rail, the external-female tactical rail, and the inner tactical female rail being aligned parallel to each other;

the first alignment pin traversing out of the first pin cavity through the first guide hole;

the first alignment pin being attached to the first mount block within the first pin cavity;

the second alignment pin traversing out of the second pin cavity through the second guide hole; and the second alignment pin being attached to the first mount block within the second pin cavity.

16. The forward pistol mount as claimed in claim 15 comprising:

the first pin cavity and the second pin cavity being positioned opposite of each other along the first mount block;

the first pin cavity and the second pin cavity laterally traversing into the first mount block;

the plurality of lug slots traversing across the first mount block; and the first pin cavity, the second pin cavity, and the plurality of lug slots being parallel to each other.

17. The forward pistol mount as claimed in claim 15 comprising:

the second mount block further comprises a bolt hole;

the first guide hole and the second guide hole being positioned opposite of each other along the second mount block;

the first guide hole, the second guide hole, and the bolt hole laterally traversing through the second mount block; and the first guide hole, the second guide hole, and the bolt hole being parallel to each other.

18. The forward pistol mount as claimed in claim 15 comprising:

the first mount block further comprises a bolt cavity;

the second mount block further comprises a bolt hole;

the securing mechanism comprises a bolt and a fastener;

the bolt cavity traversing into the first mount block;

the bolt cavity being parallel with the first pin cavity, the second pin cavity, and the plurality of lug slots;

the bolt traversing through the bolt hole and into the bolt cavity;

the bolt being attached to the first mount block within the bolt cavity;

the fastener being positioned adjacent to the second mount block opposite the first mount block; and the fastener being attached to the bolt.

19. The forward pistol mount as claimed in claim 15 comprising:

the second mount block further comprises a bolt hole;

the securing mechanism comprises a bolt and a fastener;

the bolt being connected to the first mount block;

the bolt traversing through the bolt hole;

the fastener being positioned adjacent to the second mount block opposite the first mount block; and the fastener engaging the bolt.

* * * * *